United States Patent [19]

Buckle

[11] Patent Number: 4,677,931

[45] Date of Patent: Jul. 7, 1987

[54] VARIABLE BUOYANCY APPARATUS

[76] Inventor: Brian L. Buckle, 16 Sunningdale Grove, Colwyn Bay, Clwyd, United Kingdom

[21] Appl. No.: 774,589

[22] PCT Filed: Jan. 10, 1985

[86] PCT No.: PCT/GB85/00013

§ 371 Date: Sep. 5, 1985

§ 102(e) Date: Sep. 5, 1985

[87] PCT Pub. No.: WO85/03049

PCT Pub. Date: Jul. 18, 1985

[30] Foreign Application Priority Data

Jan. 12, 1984 [GB] United Kingdom ..... 8400810

[51] Int. Cl.[4] ..... B63G 8/14

[52] U.S. Cl. ..... 114/331; 441/21

[58] Field of Search ..... 441/1, 2, 32, 33, 21; 114/331, 333, 317

[56] References Cited

U.S. PATENT DOCUMENTS

| | | | |
|---|---|---|---|
| 3,219,005 | 11/1965 | Worthing | 114/331 |
| 3,228,369 | 1/1966 | Warhurst et al. | 114/331 |
| 3,436,776 | 4/1969 | Davis | 114/331 |

*Primary Examiner*—Joseph F. Peters, Jr.
*Assistant Examiner*—Jesûs D. Sotelo
*Attorney, Agent, or Firm*—Cushman, Darby & Cushman

[57] ABSTRACT

Buoyancy apparatus for carrying a payload to and maintaining the payload at substantially a constant depth or within a desired range of depth, which comprises a variable buoyancy vessel, a depth sensor, deflectable members for detecting upwards and downward movement respectively linked to a gas supply to increase the buoyancy by displacing water from the buoyancy vessel on detecting downward movement and to decrease the buoyancy by operating a release valve to vent gas from the buoyancy vessel on detecting upward movement, and apparatus for preventing said buoyancy variations commencing until the depth sensor senses that the payload is at a predetermined depth.

11 Claims, 4 Drawing Figures

VARIABLE BUOYANCY APPARATUS

The present invention relates to buoyancy apparatus for carrying a payload to and sustaining the payload at substantially a constant depth or within a desired range of depth.

There is under a variety of circumstances a need to place an article at substantially a constant and predetermined depth in a body of water without the article being tethered to the sea bottom or suspended from the surface. It may then be desired to return it to the surface or allow it to sink to the bottom. For instance, one may wish to sample the water at a particular depth for analysis purposes. Suspending sampling apparatus from the surface by a line may be undesirable because of the danger of the line being fouled by water traffic. Tethering the sampling apparatus to the bottom may be undesirable because the bottom may be at too great a depth or may be at an unknown depth. Alternatively, one may wish to suspend a mine or sonar at about a predetermined depth.

Alternatively, one may desire to cause an article to rise and fall periodically within a desired range of depths.

For instance one may wish to have a sonar apparatus move up and down in water in a scanning movement.

The present invention provides buoyancy apparatus for carrying a payload to and maintaining the payload at substantially a constant depth or within a desired range of depth, which apparatus comprises variable buoyancy means, depth sensing means, means for detecting upward motion, means for detecting downward motion, means for automatically increasing the buoyancy of the variable buoyancy means upon the detection of downward motion, means for automatically decreasing the buoyancy of the variable buoyancy means upon the detection of upward motion, and means for preventing activation of said means for increasing and decreasing the buoyancy in response to the motion sensing means until the depth sensing means senses that the payload is at a predetermined depth.

Buoyancy apparatus of the kind described may be dropped into a body of water in a state of negative buoyancy and will then sink to a predetermined depth whereupon the depth sensing means will cease to inhibit or will produce activation of the variable buoyancy means to increase and decrease buoyancy in response to the sensing of downward or upward motion respectively. Initially, the motion sensed will be downward and this will result in an increase in the buoyancy of the variable buoyancy means to brake the fall of the apparatus. If the apparatus commences upward movement, this will be sensed by the means for detecting upward movement and this will in turn cause a decrease in the buoyancy of the variable buoyancy means. The apparatus will accordingly generally settle at a substantially constant depth. As described hereafter, delay of the increase in buoyancy may be arranged so that the device rises and falls substantially.

Alternatively, the device may be released at depth in a state of either positive or negative buoyancy, eg from a submarine.

The invention includes buoyancy apparatus for carrying a payload to and maintaining the payload at substantially a constant depth or within a desired depth range, which apparatus comprises variable buoyancy means, depth sensing means, means for sensing upward motion or means for sensing downward motion, means for automatically varying the buoyancy of the variable buoyancy means to counteract the motion sensed, means for automatically varying the buoyancy to produce motion in the direction for which the means for sensing motion is adapted when no such motion is sensed and means for preventing activation of said means for varying the buoyancy in response to the motion sensing means until the depth sensing means senses that the payload is at a predetermined depth.

Where means for detecting motion only in one direction is provided as dscribed above, the apparatus may be dropped into a body of water in a state of negative buoyancy to sink to the depth at which the depth sensing means enables the means for varying buoyancy. If the motion sensing means is adapted for sensing upward motion, it will not sense motion at this time and so the buoyancy will be increased to produce upward motion. Once upward motion is achieved the buoyancy will be automatically reduced to stop the upward motion but once it is stopped the buoyancy will be automatically increased again. The device will accordingly generally oscillate about a mean constant depth.

Apparatus including only a downward motion sensor will operate in a generally similar manner.

In achieving these functions, it is particularly desirable in many instances to avoid the use of electrical motors, pumps, switches and other electrical components. First, it is difficult to protect the electrical components from the water to give adequate reliability, that the use of electrical components may lead to undesired complexity, cost and lack of robustness. Secondly, such electrical systems generate electrical noise against which the payload of the apparatus may need to be shielded if it is to function.

Accordingly, it is preferred that the means for increasing or decreasing buoyancy are pneumatically operated and that the motion sensing means communicate with the buoyancy varying means by mechanical and pneumatic signals.

The variable buoyancy means comprises a source of pressurised gas and a buoyancy vessel having a valved inlet and outlet for said gas. The buoyancy vessel may be of variable volume, being inflated and deflated by the gas to vary the buoyancy. Alternatively, the buoyancy means may be a vessel of fixed volume with an arrangement being made for water to be displaced from the vessel by the pressurised gas to increase the buoyancy and for ambient water to displace gas from the vessel to decrease the buoyancy.

In particular, the variable buoyancy means may comprise a source of pressurised gas and a buoyancy vessel having a valved inlet and outlet for said gas and an outlet and inlet for water.

A valve or valves may be provided to open and shut the inlet and outlet for water in synchrony with the operation of the inlet and outlet valve for gas to allow displacement of water by incoming gas and to allow displacement of gas from the vessel to waste by inflowing water to achieve an increase in buoyancy and a decrease in buoyancy respectively.

In such an apparatus, the valve inlet and outlet for said gas are preferably in an upper part of the buoyancy vessel and a lower part of the buoyancy vessel preferably contains the inlet and outlet for water.

Preferably, gas pressure is applied to the inlet of the buoyancy vessel through a flow path containing a first interrupt valve which remains shut until the depth sensor senses the payload is at the predetermined depth and through a second interrupt valve which is opened thereafter upon the sensing of downward motion.

Preferably, the valved outlet for gas from the buoyancy vessel is gas pressure operated and in particular is operated by gas pressure applied thereto to open the outlet through a flowpath including said first interrupt valve and a third interrupt valve which is opened upon the sensing of upward motion if said first interrupt valve is open.

Preferably, the means for sensing downward movement comprises a diaphragm exposed against upward flow of water relative to the apparatus to be deflected thereby and means for communicating said deflection to activate means for increasing the buoyancy.

Similarly, the means for sensing upward movement preferably comprises a diaphragm exposed against downward flow of water relative to the apparatus to be deflected thereby and means for communicating said deflection to activate the means for decreasing the buoyancy.

In each case, instead of a diaphragm any other member deflectable by a water flow, e.g. a paddle, may be employed to trigger operation of the means for varying the buoyancy.

Preferably, the variable buoyancy and the power necessary to operate all of the control functions of the apparatus needed for obtaining the desired downward movement to a generally constant and predetermined level and the subsequent maintaining of that level are provided by a common source of compressed gas pressure.

The invention will be illustrated by the following description of a preferred embodiment with reference to the accompanying drawings in which.

Figure 1:
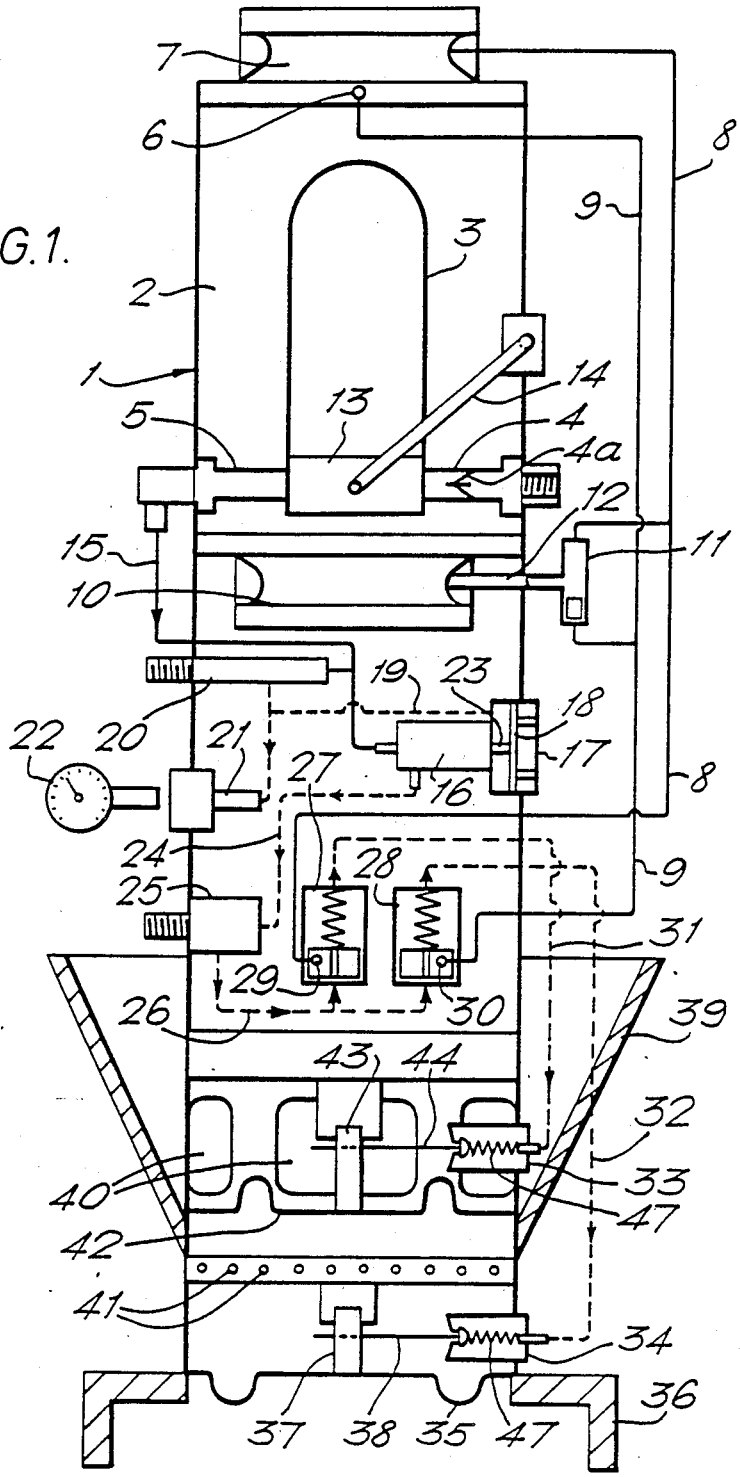
FIG. 1 is a schematic cutaway view of a buoyancy apparatus according to the invention.

The apparatus shown in FIG. 1 comprises a housing 1 having at an upper portion thereof a chamber 2 which constitutes a variable buoyancy means. Within the chamber 2 is a high pressure cylinder of gas 3 having an inlet 4 communicating with a suitable fitting on the surface of the housing through which the cylinder may be charged with high pressure gas from an external source through a one way valve 4*a*. The high pressure cylinder 3 has an outlet 5 connected to the first stage of a regulator 13 (reducing pressure to approximately 100–200 psi) which communicates through control means to be described subsequently with a valve operated inlet 6 to the chamber 2.

The inlet 6 to the chamber 2 permits the entry of gas to chamber 2 through gas line 9. A further gas line 8 communicates with valve 7. When the gas pressure is applied to valve 7 via line 8, valve 7 vents the interior of the chamber to the exterior of the apparatus.

Beneath the chamber 2 is a similar valve 10 communicating with either line 8 or with line 9 according to the position of a shuttle valve 11 interposed between lines 8 and 9 and a gas line 12 communicating with the valve itself. The arrangement is such that when the valve is exposed to gas pressure in line 8, not only is valve 7 opened but valve 10 is opened to allow venting of the interior of the chamber to the exterior of the device at the bottom of the chamber. When valve 10 is in communication with gas pressure in line 9, the valve is once again opened to communicate the interior of the chamber with the exterior of the device. When no gas pressure is applied through line 12 from either of lines 8 and 9, the valve 10 is biased to close the chamber off from the exterior.

Figure 2:
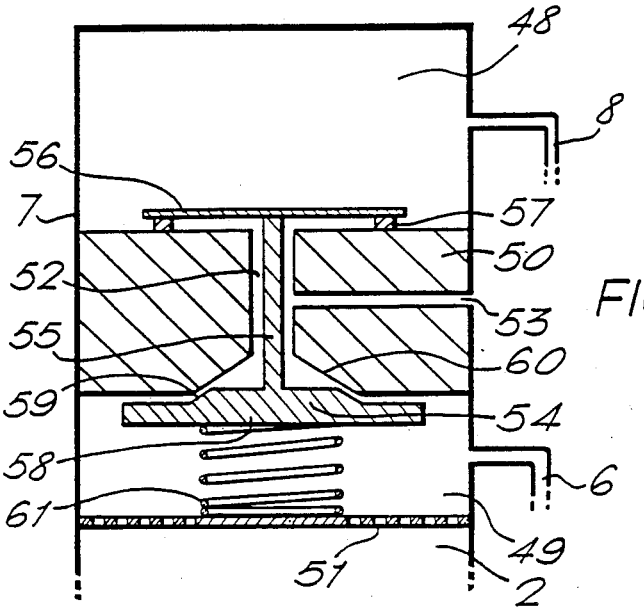
FIG. 2 is an enlarged schematic sectional view of a pneumatically activated valve for allowing escape of gas from the apparatus of FIG. 1.

The structure of valve 7 is schematically shown in FIG. 2. Valve 7 is divided into a pair of chambers 48, 49 by an intervening barrier member 50. Chamber 48 is open to gas line 8. Chamber 49 is closed from the chamber 2 at its lower end by a perforated plate 51. Chambers 48 and 49 communicate by a central bore 52 having a transverse branch 53 communicating with the exterior or a water inlet/air outlet. A double headed valve member 54 comprises a stem 55 mounted for reciprocating movement in bore 52 but not sealing bore 52. Stem 55 bears on one end a first flexible diaphragm 56 sealed to an annular member 57 in chamber 48. On the other end stem 55 bears a valve member 58 having a frusto conical seat 59 which is adapted to seat against a corresponding valve seat 60 formed on barrier member 50. Valve member 56 is biassed upwardly to close the lower value 59, 60 e.g. by a coil compression spring 61 acting between member 58 and plate 51. Gas inlet 6 communicates with chamber 49.

The chamber 2 is therefore normally sealed from the water inlet 53. When gas pressure is applied to chamber 48 via line 8, diaphragm 56 is deflected downwardly in its central area to unseat the lower valve member 54 and open the chamber 2 to the exterior via branch 53.

In conjunction with operation of valve 10 which is of similar construction to valve 7 this allows inflow of water to chamber 2 from below with loss of gas through branch 53.

The control means through which the gas pressures in lines 8 and 9 are controlled will now described.

The high pressure cylinder 3 is provided with a first pressure regulator 13 for reducing the pressure in the cylinder which may be charged initially to any convenient pressure such as 21,000 to 35,000 kN/m$^2$ (3,000 to 5,000 psi) to a constant lower pressure convenient for operating the device such as 700 to 1400 kN/m$^2$ (100 to 200 psi) e.g. 1,050 kN/m$^2$ (150 psi).

The pressure produced by the first regulator is constant relative to the water pressure to which the apparatus is exposed and in order that the regulator can sense the ambient water pressure it is provided with a line 14 for fluid communication with the exterior of the device. The outlet of the regulator 13 is connected via a gas line 15 to a first interrupt valve 16 which is opened and closed by the action of a depth sensor 17. The depth sensor and interrupt valve may be generally of the kind described in our copending British Patent Application No. 2111174 entitled 'DEPTH RESPONSIVE GAS CONTROL DEVICE'.

Generally, the depth sensor 17 comprises a diaphragm 18 exposed on the right hand side as shown to ambient water pressure and on the left hand side sealing a chamber into which a predetermined gas pressure is introduced through line 19 from a second regulator 20 which gas pressure is communicated by a branch off line 15. The gas pressure in the sealed chamber and in line 19 can be monitored at the surface of the housing 1 through a suitable valve fitment 21 and a detachable pressure gauge 22. Detachable pressure gauge 22 does not form part of the present apparatus as such. Since the combined volume of the chamber and the line 19 is small, escape of gas due to the attachment and detachment of the gauge 22 must be avoided if the pressure in the line 19 is to be set with any accuracy. Accordingly, the fitment 21 should be such as to prevent any substantial loss of gas by that route.

Diaphragm 18 is attached at its centre on the left hand side to a plunger 23, movement of which operates valve 16 to communicate gas line 15 with a gas line 24 attached to the outlet of the interrupt valve.

Gas line 24 leads to a third regulator 25, the function of which will be explained in due course. However, regulator 25 produces a reduced constant pressure which is supplied through line 26 to a pair of piston valves 27, 28. Each piston valve comprises a cylinder which contains a piston biased to a closed position in which it closes outlets 29 and 30 respectively in the cylinder wall of the piston valves. Each piston has a gas bleed bore therethrough enabling slow equilibration of gas pressure on each side of the piston. Displacement of the piston in the valve concerned exposes the respective outlet so that gas may pass from the line 26 out of the respective outlet. However, each piston divides its respective cylinder into a pair of variable volume chambers. Gas seeks to pass from the regulator into an inlet chamber of each valve displacing the piston to expand the volume of the inlet chamber whilst diminishing the volume of the second chamber of the valve. This is resisted by the sealing of each second chamber against gas outflow. Lines 31 and 32 are connected as outlets for the second chamber of each of the valves 27 and 28 and lead to a pair of whisker valves 33 and 34 respectively which are normally closed.

Whisker valve 33 is associated with means to detect upward movement of the apparatus in the water and whisker valve 34 is associated with means to detect downward movement of the apparatus in the water.

Figure 3:
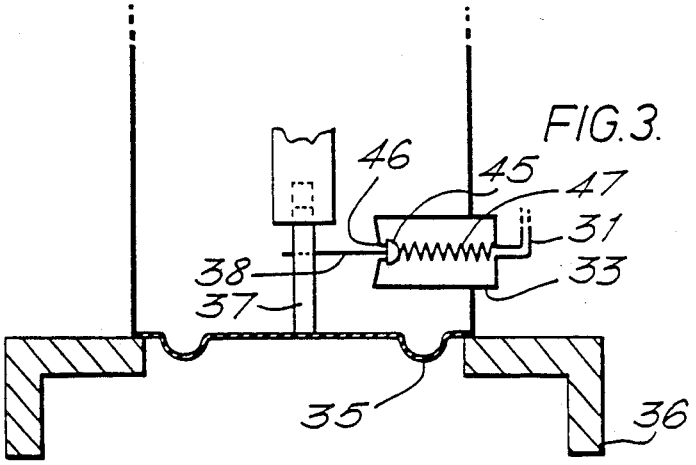
FIG. 3 is an enlarged sectional view of a whisker valve of the apparatus of FIG. 1.

Each whisker valve 33, 34 comprises a circular valve seat 46 surrounding a bore through which passes a stem 38 of a valve member having a head 45 (FIG. 3), e.g. a mushroom head, seating on the valve seat. Deflection of the stem causes the head to become lifted from the valve seat on one side to open the valve. Each valve member is biassed to seat by a coil spring 47 acting against the head.

The means for detecting downward movement of the apparatus in the water comprises a diaphragm 35 sealing an aperture in a downward facing scoop 36. Diaphragm 35 carries at its centre a pillar 37 mounted for reciprocating movement with the diaphragm. A rod 38 extends transversely from the pillar 37 and terminates in the valve member of whisker valve 34. Displacement of the diaphragm causes displacement of the valve member of whisker valve 34 from its seating to open the valve. This results in opening of the gas line 32 communicating with the second chamber of valve 28 which in turn will allow the movement of the piston in valve 28 to communicate the inlet gas pressure to that valve with the outlet of the valve and with line 9 which is connected to the outlet.

The means for detecting upward movement of the apparatus in the water is similar and comprises an upwardly facing funnel 39 for deflecting water flow into the interior of the housing through apertures 40. Water which has flowed through the funnel 39 can escape to the exterior of the housing through apertures 41 formed in a ring around the base of the funnel. Means may be provided to selectively close or partially close the apertures 41 such as a ring rotatable to obscure some or all of the apertures. The ring may be mounted in threaded engagement with the exterior of the housing for longitudinal movement on the housing to progressively obscure apertures 41.

Water flowing through the funnel and through the apertures 40 acts on a diaphragm 42 extending across the housing and carrying at its centre a pillar 43 bearing a transversely extending rod 44 terminating in the valve member of whisker valve 33. Upward movement of the apparatus in the water causes displacement of the diaphragm 42 and unseating of whisker valve 33 opening gas line 31 which allows movement of the piston in valve 27 to communicate the inlet gas pressure with the outlet of the valve which is connected to line 8.

Suitable movement detecting valves comprising a diaphragm mounted to unseat a whisker valve are described in British Patent Specification No. 2126534.

The overall operation of the apparatus is as follows. High pressure cylinder 3 is charged with high pressure gas, for instance to the pressures previously mentioned. The first pressure regulator 13 is set to provide a satisfactory outlet pressure. The depth sensor 17 is set to respond at a particular depth by the setting of gas pressure in the chamber thereof using regulator 20 and monitoring the pressure on gauge 22 which may be calibrated directly in depth units. A satisfactory outlet pressure is then set on the third adjustable regulator 25. The pressure on the third regulator 25 is communicated, when valves 27 and 28 are shut, through lines 31,32 to the whisker valves 33,34. The higher the pressure applied to these whisker valves the more difficult it is to unseat them and so the higher the velocity needed to be detected by the movement sensing means before these valves are opened.

The apparatus is then dropped into the water attached to whatever payload is in question in a state of negative buoyancy produced by introducing an adequate quantity of water into chamber 2. The apparatus will sink.

The apparatus will continue to sink until a depth is reached such that the water pressure deflects the diaphragm 18 of the depth sensor 17 causing a communication of the outlet pressure of regulator 13 in line 15 through line 24 and the third regulator 25 to the valves 27,28. As the apparatus is descending at this time, diaphragm 35 will be deflected upwardly and whisker valves 34 will be unseated. This will enable gas to vent from the chamber of valve 28 deflecting the piston therein. There will be no back resistance because line 32 is opened by the whisker valve 34. Gas will therefore pass through the valve 28 out through its outlet 30 into line 9. The gas pressure in line 9 will operate the shuttle valve 11 to close off the connection there to line 8 and to communicate gas pressure to valve 10 and to the inlet 6 of the chamber. Valve 7 will at this point be closed. The gas pressure acting on valve 10 will open this valve and gas will therefore be introduced into the chamber through inlet 6 displacing water out of the chamber through valve 10 and increasing the buoyancy of the apparatus. Eventually, the apparatus will cease to descend and will probably commence ascending. At this point, whisker valve 34 will reseat, pressure will equalise on each side of the piston in valve 28 and the biasing in the valve will move the piston in the valve 28 to close the outlet 30 thus cutting off pressure from valve 10 and the inlet 6. If upward movement is sensed by the diaphragm 42, this diaphragm will be deflected downwardly unseating whisker valve 33 which will result in the operation of valve 27 which will open to allow passage of gas from regulator 25 through the outlet 29 into line 8. Gas pressure in line 8 will open valve 7 venting the air in the chamber 2 to the exterior of the device. The pressure in line 8 will also reverse the operation of the shuttle valve 11 communicating line 8 with valve 10 and shutting off the communication of valve 10 with line 9. Valve 10 will thereby be opened to allow ingress of water into chamber 2 displacing air from the chamber through valve 7 and lowering the buoyancy of the apparatus. The ascent will eventually stop. If the apparatus commences to descend, the previously described sequence of operation upon descent will occur and the buoyancy will increase. The device will accordingly eventually reach a stable depth which will be maintained so long as gas pressure is provided in the high pressure cylinder.

If desired, means may be provided to override the automatic depth control mechanism described above and cause the apparatus to rise to the surface or sink to the bottom after some predetermined length of time, or upon a given signal, or upon some specified event occurring. One such specified event may be the expiry of the high pressure cylinder. In such a case, a reserve cylinder may be provided and connected to increase the buoyancy of the apparatus to bring it to the surface once control is lost through expiry of the charge in the high pressure cylinder 3.

The apparatus may be used to position any desired payload such as an automatic water sampling apparatus.

Figure 4:
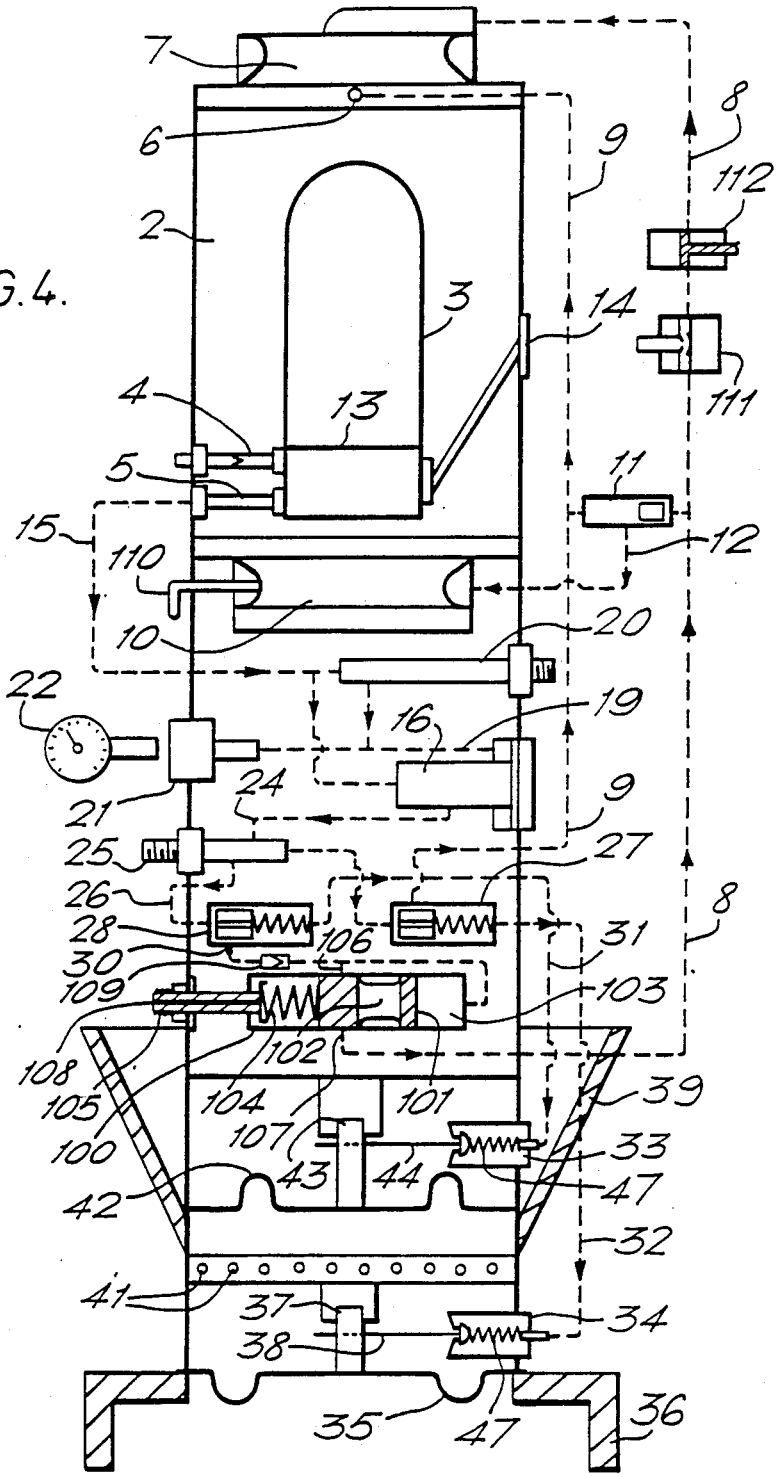
FIG. 4 is a schematic cutaway view of a second embodiment according to the invention.

FIG. 4 shows an alternative embodiment of the invention adapted to rise and fall within a desired depth range. The apparatus is generally similar to the embodiment of FIG. 1 and corresponding parts are numbered as in FIG. 1.

As compared with FIG. 1, FIG. 4 shows the following modifications.

The valved outlet 30 of piston valve 28 is connected via a non-return valve 109 to a branched conduit leading to a delay valve 100. Delay valve 100 comprises a cylinder containing a piston 101 through which a bore 102 extends transversely. To the right of piston 101 in the cylinder is a variable volume gas chamber 103. To the left of piston 101, the cylinder contains a coil spring 104 biassing the piston 101 to the right. The pressure exerted by the spring 104 is adjustable by rotation of a threaded stud 105 extending from the cylinder through the casing of the device and bearing at its internal end upon the coil spring 104. A bleed 108 extends through stud 105 into the cylinder to the left of piston 101.

The delay valve 100 has a first inlet at the extreme right hand end thereof connected to piston valve outlet 30 via non-return valve 109, thus communicating outlet 30 and gas space 103. A second inlet 106 to the side of the cylinder of the delay valve 100 is also connected to outlet 30 via non-return valve 109 and hence is also connected to gas space 103 but is normally blocked by the piston 107. A corresponding outlet 107 in the wall of the cylinder of the delay valve 100 is similarly normally blocked by the piston 101. Displacement of the piston 101 to the left against spring 104 enables the gas space 103, inlet 106, and the outlet 107 to communicate via bore 102.

Thus, in use, when motion sensor diaphragm 42 is deflected so as to unseat whisker valve 34, gas pressure is applied from outlet 30 to chamber 103. Normally, this will not be sufficient at first to deflect the piston 101 to the left. Accordingly, no gas pressure is applied at this stage through line 8.

Accordingly, the device will continue to rise. The depth sensor and interrupt valve 16, 17 will during this rise close off the gas pressure applied through line 24.

The quantity of gas trapped in gas space 103 expands against the decreasing ambient water pressure communicated to the left side of the piston 107 by bleed 108, until the piston is sufficiently displaced to communicate inlet 106 to outlet 107 through piston bore 102. The gas in the gas space 103 can then escape into line 8 to operate the valves 7 and 10 to cause the device to take on ballast and sink. The gas space 103 will need to be of sufficient size having regard to the change of pressure it will experience to provide operation of valves 7 and 10. It may be convenient to supplement the capacity of the gas space 103 by providing a gas reservoir connected thereto.

As the depth sensor 16 is above its preset depth, no gas pressure is available to cause movement of the lower diaphragm 35 to produce an increase of buoyancy. Once the device sinks sufficiently to trigger depth sensor 16 however, the movement sensed by diaphragm 35 causes injection of gas to displace water from chamber 2 in the manner described with reference to FIG. 1.

Accordingly, the device shown in FIG. 4 can be set to fall to a preset depth, rise again to the surface or to a second preset depth and to continue oscillating between the first and second depths or the surface and a preset depth.

As shown in FIG. 4, the device comprises a pressure relief valve 110 serving to prevent the pressure difference between the chamber 2 and ambient exceeding a preset maximum during ascent. The valve 110 may have an outlet set at an angle so that venting of gas therefrom during ascent causes the device to rotate about its axis.

Since the gas pressure injected into chamber 103 and trapped therein will increase relative to ambient as the device rises (and ambient pressure falls), and may exceed ambient very significantly at the minimum depth to which the device travels, line 8 through which this pressure is discharged to valve 7, and optionally line 12 to valve 10 may contain a pressure relief valve 111 and/or a bleed valve 112.

Pressure relief valve 111 is adjustable to allow setting of the maximum pressure in line 8, any excess being vented by the valve.

Bleeding valve 112 provides a variable flow restriction in line 8 and can be used to cause a delay in the operation of valve 7 after the release into line 8 of the pressure in chamber 103. Thus valve 10 will open before valve 7. As the gas in chamber 2 will generally be substantially above ambient pressure at this time, this will allow water, and possibly thereafter gas, to escape from the chamber 2 to equalise pressures before valve 7 is opened. This escape of water will cause an increase in buoyancy.

The flow restriction provided by bleed valve 112 also prevents a sudden shock of pressure being applied to valve 7.

Thus, the device shown in FIG. 4 is adapted to sink to a predetermined depth and thereafter to oscillate between maximum and minimum preset depths or between the surface and a preset depth.

It will be appreciated that the invention is not restricted to the detailed features described above with reference to the drawings and that numerous modifications and variations can be made to the apparatus particularly described without departing from the invention.

I claim:

1. Buoyancy apparatus for carrying a payload to and maintaining the payload within a desired range of depth, which apparatus comprises variable buoyancy means, depth sensing means, means for detecting upward motion, means for detecting downward motion, means for automatically increasing the buoyancy of the variable buoyancy means in response to the detection of downward motion, means for automatically decreasing the buoyancy of the variable buoyancy means in response to the detection of upward motion, and means for preventing activation of said means for increasing and decreasing the buoyancy in response to the motion detecting means until the depth sensing means senses that the payload is at a predetermined depth, wherein the variable buoyancy means comprises a source of pressurised gas and a buoyancy vessel having an inlet for said gas provided with an inlet valve and an outlet for said gas provided with an outlet valve.

2. Apparatus as claimed in claim 1 wherein the apparatus comprises an inlet and an outlet for water valve means adapted to open and shut the inlet and outlet for water in synchrony with the operation of the inlet and outlet valves for gas to allow displacement of water by incoming gas and to allow displacement of gas from the vessel to waste by inflowing water to achieve an increase in buoyancy and a decrease in buoyancy respectively.

3. Apparatus as claimed in claim 1 comprising means defining a gas flow path for applying gas pressure to the inlet for gas of the buoyancy vessel, said flow path containing a normally shut first interrupt valve and a normally shut second interrupt valve the apparatus including means for opening the first interrupt valve upon said depth sensing means sensing that the payload is at the predetermined depth and wherein the second interrupt valve is adapted and connected to open upon the detecting of downward motion by the means for detecting downward motion.

4. Apparatus as claimed in claim 3 wherein the valved oulet for gas from the buoyancy vessel is adapted to be operated by applied gas pressure and said apparatus comprises a gas flow path including said first interrupt valve and a third interrupt valve adapted and connected to be opened upon the detecting of upward motion by the means for detecting upward motion.

5. Apparatus as claimed in claim 1 wherein the means for detecting downward movement comprises a deflectable member exposed against upward flow of water relative to the apparatus to be deflected thereby and means for communicating said deflection to activate means for increasing the buoyancy.

6. Apparatus as claimed in claim 1 wherein the means for detecting upward movement comprises a deflectable member exposed against downward flow of water relative to the apparatus to be deflected thereby and means for communicating said deflection to activate the means for decreasing the buoyancy.

7. Apparatus as claimed in claim 1 wherein said depth sensing means, motion detecting means and buoyancy varying means are adapted for gas pressure powered operation and comprising a common source of compressed gas pressure for providing gas to the variable buoyancy means and for providing all power necessary to operate the depth sensing and the motion detecting means and the buoyancy varying means.

8. Apparatus as claimed in claim 1 comprising a flow path for gas to the inlet for gas of the buoyancy vessel including an interrupt valve which comprises a cylinder divided by a piston movable between a valve open position and a valve closed position, an inlet for gas to the cylinder, a main gas outlet from the cylinder closed when the piston is in the valve closed position and a permanently open subsidiary gas outlet from the cylinder separated from the gas inlet to the cylinder by the piston, a gas bleed flow path comprising means defining a gas flow path from said subsidiary gas outlet to a normally shut venting valve having an operating member connected to said means for detecting downward movement so as to open the venting valve upon detection of said movement, thereby to allow movement of the piston of the interrupt valve from the valve closed to the valve open position displacing gas through the subsidiary gas outlet of the interrupt valve.

9. Apparatus as claimed in claim 1 comprising a flow path for gas to the outlet for gas of the buoyancy vessel including an interrupt valve which comprises a cylinder divided by a piston movable between a valve open position and a valve closed position, an inlet for gas to the cylinder, a main gas outlet from the cylinder closed when the piston is in the valve closed position and a permanently open subsidiary gas outlet from the cylinder separated fom the gas inlet by the piston, a gas bleed flow path communicating the portions of the cylinder separated to the cylinder by the piston, and means biassing the piston to the valve closed position, said apparatus further comprising means defining a gas flow path from said subsidiary gas outlet to a normally shut venting valve having an operating member connected to said means for detecting upward movement so as to open the venting valve upon detection of said movement, thereby to allow movement of the piston of the interrupt valve from the valve closed to the valve open position displacing gas through the subsidiary gas outlet of the interrupt valve.

10. Buoyancy apparatus for carrying a payload to and maintaining the payload within a desired depth range, which apparatus comprises variable buoyancy means, depth sensing means, means for detecting upward motion, means for automatically decreasing the buoyancy of the variable buoyancy means when upward motion is detected, means for automatically increasing the buoyancy to produce upward motion when no upward motion is detected and means for preventing activation of said means for increasing and decreasing the buoyancy until the depth sensing means senses that the payload is at a predetermined depth, wherein the variable buoyancy means comprises a source of pressurised gas and a buoyancy vessel having an inlet provided with an inlet valve and an outlet for said gas provided with an outlet valve.

11. Buoyancy apparatus for carrying a payload to and maintaining the payload within a desired depth range, which apparatus comprises variable buoyancy means, depth sensing means, means for detecting downward motion, means for automatically increasing the buoyancy of the variable buoyancy means when downward motion is detected, means for automatically decreasing the buoyancy to produce downward motion when no downward motion is detected and means for preventing activation of said means of increasing and decreasing the buoyancy until the depth sensing means senses that the payload is at a predetermined depth, wherein the variable buoyancy means comprises a source of pressurised gas and a buoyancy vessel having an inlet for said gas provided with an inlet valve and an outlet for said gas provided with an outlet valve.

* * * * *

UNITED STATES PATENT AND TRADEMARK OFFICE

CERTIFICATE OF CORRECTION

PATENT NO. : 4,677,931

DATED : July 7, 1987

INVENTOR(S) : Brian Leonard BUCKLE

It is certified that error appears in the above-identified patent and that said Letters Patent is hereby corrected as shown below:

On the title page Item (21) should read:
Serial Number is 774,598

Signed and Sealed this

Eighth Day of December, 1987

*Attest:*

DONALD J. QUIGG

*Attesting Officer*

*Commissioner of Patents and Trademarks*